US009598839B2

(12) United States Patent
Choi et al.

(10) Patent No.: US 9,598,839 B2
(45) Date of Patent: Mar. 21, 2017

(54) CONSTRUCTION EQUIPMENT

(71) Applicant: HYUNDAI HEAVY INDUSTRIES CO., LTD., Ulsan (KR)

(72) Inventors: Kye Hyun Choi, Seoul (KR); Jong Hyung Yim, Yongin-si (KR); Sang Hoon Lee, Yongin-si (KR); Ho Youn Lee, Seoul (KR)

(73) Assignee: HYUNDAI HEAVY INDUSTRIES CO., LTD., Ulsan (KR)

( * ) Notice: Subject to any disclaimer, the term of this patent is extended or adjusted under 35 U.S.C. 154(b) by 0 days.

(21) Appl. No.: 14/764,220

(22) PCT Filed: Dec. 13, 2013

(86) PCT No.: PCT/KR2013/011564
§ 371 (c)(1),
(2) Date: Jul. 29, 2015

(87) PCT Pub. No.: WO2014/123300
PCT Pub. Date: Aug. 14, 2014

(65) Prior Publication Data

US 2015/0368878 A1 Dec. 24, 2015

(30) Foreign Application Priority Data

Feb. 5, 2013 (KR) ..... 10-2013-0013099
Nov. 18, 2013 (KR) ..... 10-2013-0140133

(51) Int. Cl.
*E02F 3/32* (2006.01)
*E02F 9/22* (2006.01)
*E02F 3/43* (2006.01)

(52) U.S. Cl.
CPC ..... *E02F 9/2203* (2013.01); *E02F 3/32* (2013.01); *E02F 3/435* (2013.01); *E02F 9/2285* (2013.01);
(Continued)

(58) Field of Classification Search
None
See application file for complete search history.

(56) References Cited

U.S. PATENT DOCUMENTS 5,598,648 A 2/1997 Moriya et al.
2013/0042935 A1* 2/2013 Post ..... F15B 11/006 137/561 R

FOREIGN PATENT DOCUMENTS

JP 09-287176 A 11/1997
JP 10-168949 A 6/1998
(Continued)

OTHER PUBLICATIONS

Machine Translation of JP 2011-236562.*
International Search Report for PCT/KR2013/011564 mailed Mar. 20, 2014 from Korean Intellectual Property Office.

*Primary Examiner* — John R Olszewski
*Assistant Examiner* — James M McPherson
(74) *Attorney, Agent, or Firm* — Paratus Law Group, PLLC

(57) ABSTRACT

Disclosed is a construction equipment including: a boom operating unit including a boom, a boom cylinder, and a boom head and rod return solenoids for controlling the extension of the boom by controlling the ascending and descending of the boom cylinder; an arm operating unit comprising an arm and an arm cylinder so as to move the arm by controlling the extension of the arm cylinder; and a control unit for generating a flow path connection signal in at least a part of the boom head and rod return solenoids upon operation of an arm lever in a boom float mode so as to control the boom cylinder.

7 Claims, 3 Drawing Sheets

(52) U.S. Cl.
CPC ..... *E02F 9/2292* (2013.01); *F15B 2211/355* (2013.01); *F15B 2211/41581* (2013.01); *F15B 2211/426* (2013.01); *F15B 2211/6316* (2013.01); *F15B 2211/6355* (2013.01); *F15B 2211/6658* (2013.01)

(56) References Cited

FOREIGN PATENT DOCUMENTS

| | | | |
|---|---|---|---|
| JP | 2011-236562 | A | 11/2011 |
| KR | 20-2001-0001834 | U | 1/2001 |
| KR | 10-2006-0068668 | A | 6/2006 |

* cited by examiner

CONSTRUCTION EQUIPMENT

CROSS REFERENCE TO PRIOR APPLICATION

This application is a National Stage Patent Application of PCT International Patent Application No. PCT/KR2013/011564 (filed on Dec. 13, 2013) under 35 U.S.C. §371, which claims priority to Korean Patent Application No. 10-2013-0013099 (filed on Feb. 5, 2013) and 10-2013-0140133 (filed on Nov. 18, 2013), which are all hereby incorporated by reference in their entirety.

TECHNICAL FIELD

This disclosure relates to a construction equipment, more particularly, a construction equipment for controlling a float mode of a boom cylinder in a construction equipment.

BACKGROUND ART

Generally, an excavator is equipped with a front work device such as a boom, an arm, a bucket etc. at an upper turning body, and individually or simultaneously operates one or more of corresponding work devices with a pressurized fluid discharged in one or more hydraulic pump to perform various multiple works such as an excavation work, ground leveling, material collecting work, load work etc. Here, a multiple work means a work that is performed through simultaneously operating more than two hydraulic devices among a boom, an arm, a turning motor.

Meanwhile, Korean Patent Publication NO. 10-2006-0068668 is related to a hydraulic control device controlling a multiple movement simultaneously operating a boom and arm of excavator, as a boom valve automatically increases or decreases a boom speed according to an operation level of valve, preferentially provides a lot of pump flux to a boom in case of multiple work such as a load work or evenness work in which a change of boom operation load is bigger than a change of arm operation load.

Such exiting art necessarily needs a skilled operation of worker because a boom and arm needs to be accurately moved along a ground when ground leveling or material collecting work which is one of main works of construction equipment like excavator, and has drawback that is increase of worker's tiredness when such operation is repeated.

Therefore, an equipment that is equipped with a float circuit that connects a boom cylinder rod or head hydraulic circuit with hydraulic thank to descend a boom by self-weight of work device instead of pump pressure or ascend a boom by ground reaction force when worker intends to facilitate work is being developed.

However, because a return operation in which a boom is lifted for a bucket to be moved after an operation in which bucket moves along a ground is needed even in such case, a drawback still exists, in that work is performed by an operation of a boom and arm.

Technical Problem

One embodiment of the present invention proposes a construction equipment for facilitating a work (for example, ground leveling and material collection work) that need to simultaneously operate a boom and arm of construction equipment with just an arm operation.

One embodiment of the present invention proposes a construction equipment for adjusting an excavation force of a construction equipment with a simple operation of boom lever.

Technical Solution

In some embodiments, construction equipment includes a boom operating unit including a boom, a boom cylinder, a boom head return solenoid and a boom rod return solenoid, the boom head and rod return solenoids configured to control an extension of the boom cylinder to control an ascending and descending of the boom, an arm operating unit configured to control an arm, an arm cylinder and an extension of the arm cylinder to move the arm and a control unit configured to output a flow path connection signal to at least of the boom head and rod return solenoids to control the boom cylinder when an arm lever is manipulated in a boom float mode.

when the boom float mode corresponds to an arm-in mode, the control unit outputs the flow path connection signal to the boom head return solenoid and the boom rod return solenoid to connect head and rod flow paths of the boom cylinder with a hydraulic tank.

when a ground reaction force by a bucket in the arm-in mode is not generated, the boom descends through a contraction of the boom cylinder.

when the ground reaction force by the bucket in the arm-in mode is generated, the boom is regulated so that the bucket moves along a corresponding ground.

when the boom float mode corresponds to an arm-out mode, the control unit outputs the flow path connection signal to the boom rod return solenoid to connect a rod flow path of the boom cylinder with a hydraulic tank.

the boom maintains a corresponding position or ascends at a time point where a ground reaction force by bucket is lastly generated in the arm-out mode.

In one embodiment, when the boom float mode corresponds to a boom down mode, the control unit generates the flow path connection signal to the boom head return solenoid to connect a head flow path of the boom cylinder with a hydraulic tank.

In one embodiment, the boom head return solenoid connects an orifice to an interior or passageway to decrease a descending speed of the boom.

In one embodiment, construction equipment further includes a worker input device configured to output a boom float mode selection signal according to an operation of a worker wherein the control unit applies or cancels one or more of the float mode according to the boom float mode selection signal.

Technical Effects

A construction equipment according to one embodiment of the present invention has effect that does not need skilled work and reduces tiredness of work in repeated work as connecting an operation direction of an arm lever to whether a boom float circuit works to perform a work (for example, ground leveling and material collection work) that need to simultaneously operate a boom and arm of construction equipment with just an arm operation.

A construction equipment according to one embodiment of the present invention has effect that, performs an accurate work and load work because work is not interrupted, as connecting an operation degree of boom lever to whether a boom float circuit works to adjust a excavation force without additional change switch.

MODE FOR INVENTION

The following describes embodiments of the present invention with example figures so that a person skilled in the relevant field of technology easily uses the present invention. However, the present invention may be embodied in various and different form and is not limited to embodiments described here. And for clearly illustrating the present invention unrelated part to illustration is leaved out of example figures, and similar mark is affixed to similar part through entire patent specification.

Figure 1:
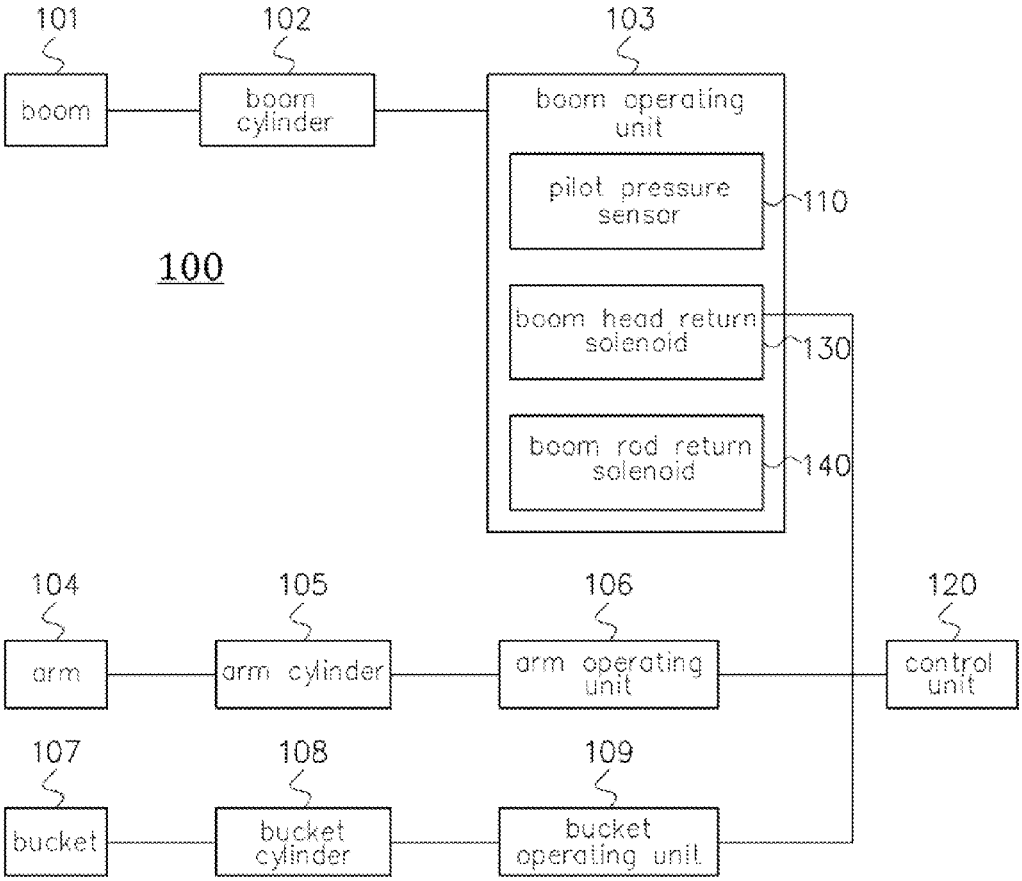
FIG. 1 is a composition block diagram illustrating composition of boom float mode control system according to one embodiment of the present invention.

FIG. 1 is a composition block diagram illustrating composition of boom float mode control system according to one embodiment of the present invention.

As a construction machine used when digging in a ground or reducing land, a excavator that is a kind of a construction equipment 100 may perform an excavation work digging in a ground in a public work, architecture, construction site, loading work carrying an earthy material, crushing work dismantling a building and a ground leveling work etc., and may be formed with a driving body in charge of movement of an equipment, an upper turning body installed in a driving body to rotate a full 360-degree and a work device.

Referring FIG. 1, construction equipment 100 basically performs an excavation or material movement through a boom 101, an arm 104 and a bucket 107. A boom 101 means a part connecting body of an excavator and an arm 104, and an arm 104 means a part connecting a boom 101 and a bucket 107. A bucket 107 means a part digging in a ground or lifting a material.

A boom 101 operates through a boom cylinder 102 and a boom operating unit 103. A boom 101 may be moved by extension of a boom cylinder 102 and a boom cylinder 102 may be extended by a boom operating unit 103. A boom operating unit 103 may include a pilot pressure sensor 110, a boom head return solenoid 130 and a boom rod return solenoid 140. An action of a boom operating unit 103 is illustrated in detail through FIG. 2.

An arm 104 operates through an arm cylinder 105 and an arm operating unit 106. An arm 104 may be moved by an extension of an arm cylinder 105, and an arm cylinder 105 may be extended by an arm operating unit 106.

A bucket 107 is connected to an arm 104 to perform a work such as an excavation or material movement etc. a bucket 107 may be moved by an extension of a bucket cylinder 108, and may be extended by a bucket operating unit 109.

A control unit 120 controls a boom operating unit 103, an arm operating unit 106 and a bucket operating unit 109. A control unit 120 is illustrated in detail through FIG. 2.

En excavator may be further equipped with a main motor moving an upper turning body, and at this time a main motor uses a strong fluid pressure to turn an upper turning body. A fluid pressure generated in the process of a corresponding turning is generated by a main pressure formed in a pump of an excavator. Such main pressure may be connected with a protruding pole-shaped boom cylinder 102 supporting a work device and an arm cylinder 105 using a fluid pressure to support an arm 104 of an excavator.

Figure 2:
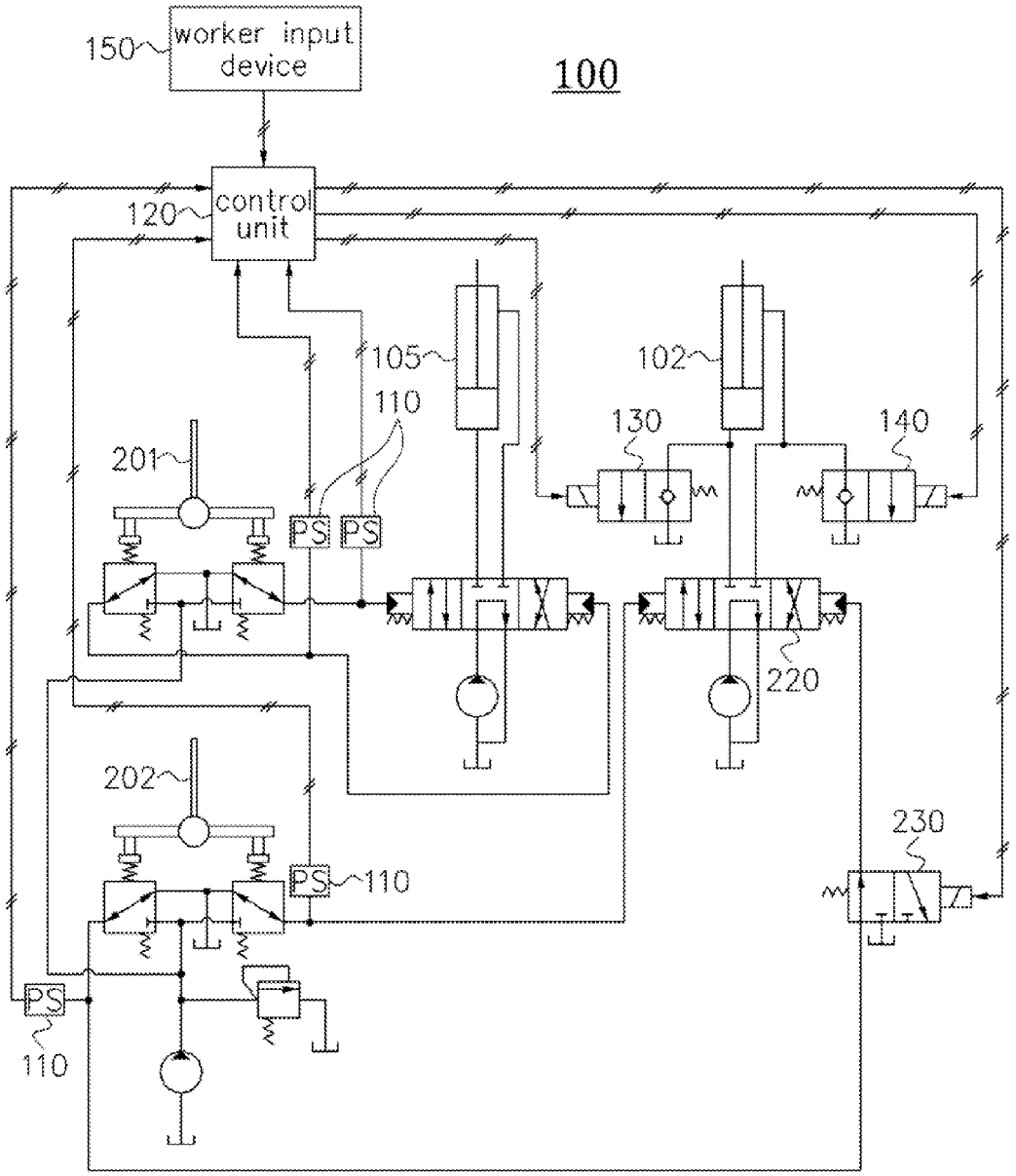
FIG. 2 is a block diagram illustrating a boom float mode determine according to a lever operation in FIG. 1.

FIG. 2 is a block diagram illustrating a boom float mode determine according to a lever operation.

Referring FIG. 2, an arm lever 201 and a boom lever 202 is included in a driver's cage. According to an operation direction of a corresponding lever one or more pilot pressure is formed, each work device driving valve (arm driving valve and boom driving valve) determines an action direction of a main pressure formed in a pump according to a formed pilot pressure.

A pilot pressure sensor 110 is installed in a flow path in which a pilot pressure is formed to detect a pilot pressure value, and outputs a pilot pressure signal corresponding to a detected pressure value to a control unit 120.

A control unit 120 determines a boom float mode according to a pilot pressure signal received from a pilot pressure sensor 110, and accordingly generates a flow path connection signal to output to a boom head return solenoid 130 or a boom rod return solenoid 140.

A boom head return solenoid 130 performs a role connecting a head flow path of a boom cylinder with a hydraulic tank of an excavator. As a boom head return solenoid 130 receives a flow path connection signal outputted from a control unit 120 to connect a head flow path of a boom cylinder 102 with a hydraulic tank to open a flow path, makes it possible for a boom cylinder 102 to contract by an external force irrespective of a fluid pressure entered from a main pump.

A boom rod return solenoid 140 performs a role connecting a rod flow path of a boom cylinder 102 with a hydraulic tank of an excavator. As a boom rod return solenoid 140 receives a flow path connection signal outputted from a control unit 120 to connect a rod flow path of a boom cylinder 102 with a hydraulic tank to open a flow path, makes it possible for a boom cylinder 102 to be stretched by an external force irrespective of a fluid pressure entered from a main pump.

In one embodiment, an arm-in mode that is one of boom float mode means a moment in which a pilot pressure value is an arm-in direction stretching an arm cylinder 105. In arm-in mode, a control unit 120 outputs a flow path connection signal to a boom head return solenoid 130 and a boom rod return solenoid 140 to connect a boom head flow path and a boom rod flow path with a hydraulic tank. In arm-in mode, a bucket 107 moves along a location where a self-weight and ground reaction force matches without additional operation of boom lever 202.

In case in which a boom float mode corresponds to an arm-in mode, if a ground reaction force is not generated by a bucket 107, a boom 101 may descend through contraction of a boom cylinder 102.

Also, in case in which a boom float mode corresponds to an arm-in mode, if a ground reaction force is generated by a bucket 107, a boom 101 may be adjusted so that a corresponding bucket 107 moves along a corresponding ground.

In one embodiment, an arm-out mode that is one of boom float mode means a moment in which a pilot pressure value is an arm-out direction contracting an arm cylinder 105. In an arm-out mode, a control unit 120 outputs a flow path connection signal to a boom rod return solenoid 140 to connect a boom rod flow path with a hydraulic tank. In arm-out mode, a boom cylinder 102 may be stretched through a force that is pushed by a ground reaction force for a bucket 107 without additional operation of boom lever 202.

In case in which a boom float mode corresponds to an arm-out mode, a boom 101 may maintain a corresponding position or ascend at a time point where a ground reaction force by bucket 107 is generated lastly.

Figure 3:
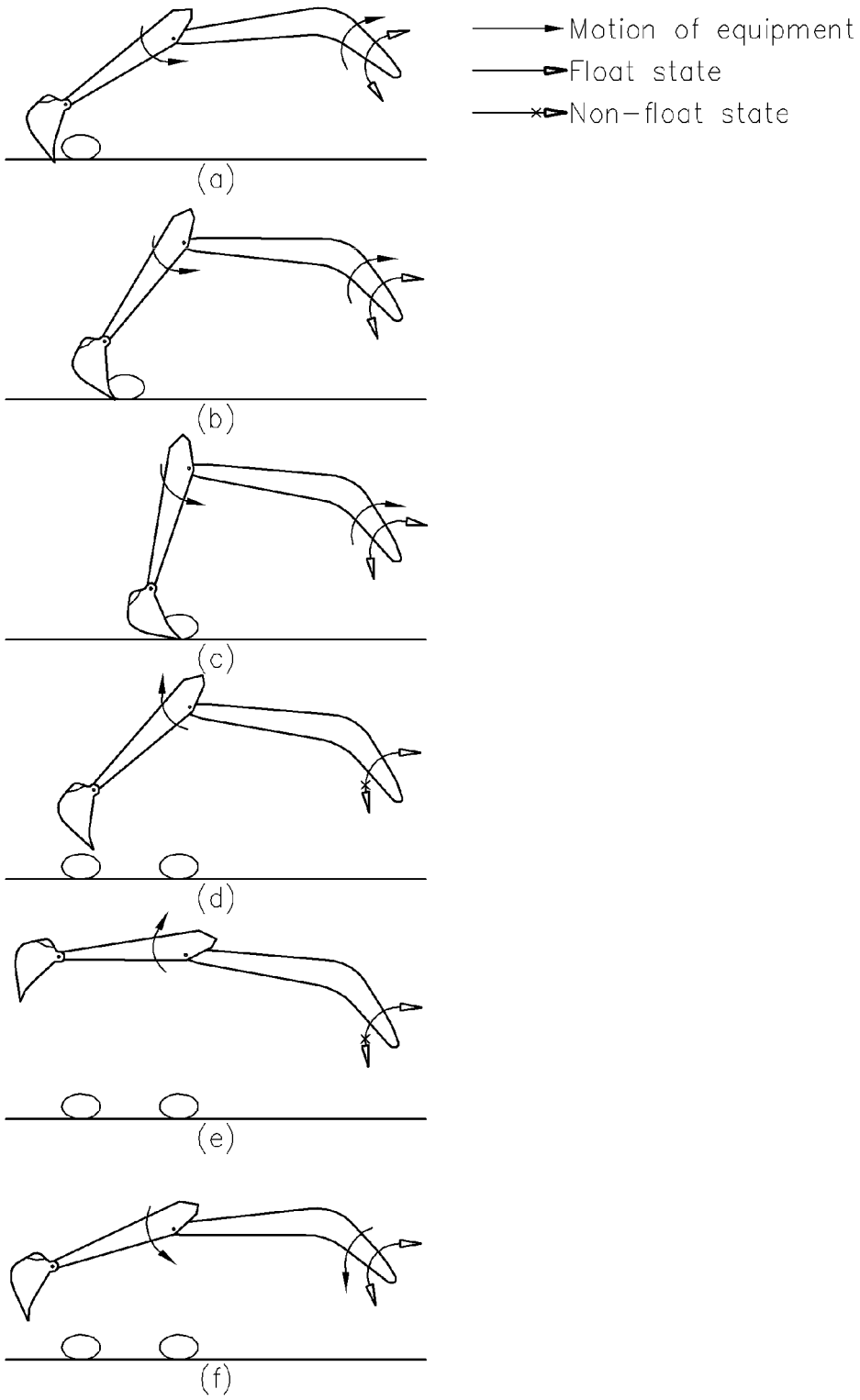
FIG. 3 is an action diagram illustrating an action of a boom, arm and bucket of an excavator according to a float mode determined by a control unit.

As a worker moves just an arm lever 201 in direction of an arm-in and arm-out through an arm-in mode or arm-out mode, may perform a leveling and material collecting work without an operation of a boom lever 202. Detailed description about this is illustrated in FIG. 3.

In one embodiment, a boom down mode that is one of boom floating mode means a moment in which a pilot pressure value is a boom down direction contracting a boom cylinder 102 and corresponding pilot pressure value is within a set range. In a boom down mode, a control unit 120 outputs a flow path connection signal to a boom head return solenoid 130 to descend a boom cylinder 102 by a self-weight when a boom lever 202 is operated minutely, and to apply a pressure of a main pump to a rod of a boom 101 when a boom lever 202 is pushed to the end for a pilot pressure is largely formed in a boom driving valve. It reflects a fact that a worker operates a lever minutely when a small excavation force is needed for exquisite work, and worker operates a lever to put a lever to the end when a worker needs a big excavation force of a work device.

In one embodiment, a construction equipment 100 is equipped with a boom pilot pressure cut-off solenoid 230 cutting off a pilot pressure moving a boom driving valve 220, when a control unit 120 generates a flow path connection signal to a boom head return solenoid 130 according to a movement of a boom lever 202, outputs a pressure cut-off signal to a boom pilot pressure cut-off solenoid 230 to prevent a boom driving valve 220 from being driven. When a boom lever 202 is operated for a boom driving valve 220 to be driven, a boom does not descend by a self-weight but is driven by a fluid pressure of a main pump for a pressure to be largely formed.

In one embodiment, a boom head return solenoid 130 further connects an orifice to an interior of a boom 101 or passageway in order to decrease a descending speed of a boom 101 when a boom 101 descends in ground direction.

In one embodiment, a construction equipment 100 is additionally equipped with a switch outputting a boom float mode selection signal according to a worker's operation or a worker input device 150 such as a touch sensitive monitor, and a control unit 120 may apply or cancel one or more of a boom float mode according to a boom float mode selection signal outputted in a worker input device 150.

FIG. 3 is an action diagram illustrating an action of a ground leveling and material collecting by manipulating of an arm lever of a boom float mode.

Referring FIG. 3, (a)~(c) illustrate an arm-in mode in which a worker manipulates an arm lever 201 in an arm-in direction. In an arm-in mode, an ascending and descending of a boom 101 is determined according to a shape of ground. Also, a bucket 107 moves an earthy material or work material (marked part in oval shape) in a body direction of an excavator by an angle adjusting of an arm 104 without additional operation.

In an arm-in mode, an arm 104 moves in a boom direction (in other words, arm-in direction), because an angle between an arm 104 and ground increases, so a boom 101 naturally ascends with a reaction force of ground.

(d)~(e) illustrate an arm-out mode in which a worker manipulates an arm lever so that an arm lever is inclined toward an arm-out direction. In an arm-out mode, it is possible for a boom only to ascend in (c) state or to maintain a height of (c) state. Therefore, even without additional operation of a bucket 107, a bucket 107 may move without being bumped against a new earthy material or work material (marked part in oval shape).

When a worker manipulates an arm lever to be slightly inclined in an arm-in direction, a worker again enters an arm-in mode (entering (f) from (e)) and a boom head flow path is connected with a hydraulic tank and a boom cylinder 102 contracts for a boom 101 to naturally descend, however, because a length of an arm cylinder 105 is hardly ever changed so an arm 104 hardly ever moves in an inner direction of a boom 101, accordingly a bucket 107 may move into distant position from an excavator.

On the other hand, when a worker manipulates an arm lever to be completely inclined in an arm-in direction, a boom head flow path completely open to be connected with a hydraulic tank, a length of a boom cylinder 102 contracts for a boom 101 to descend and at the same time a length of an arm cylinder 105 is stretched relatively fast, so an arm 104 may move in inner direction of a boom 101 and a bucket 107 may move into close position from an excavator.

Repeating the above-stated action, an earthy material or work material may be collected or leveled only with manipulating of an arm lever 201.

While the disclosure has been described in terms of exemplary embodiments, those skilled in the art will recognize that the disclosure can be practiced with modifications in the spirit and scope of the appended claims.

The invention claimed is:

1. A construction equipment comprising:

a boom operating unit including a boom, a boom cylinder, a boom head return solenoid and a boom rod return solenoid, the boom head and rod return solenoids configured to control an extension of the boom cylinder to control an ascending and descending of the boom;

a boom lever configured to generate a first signal for controlling a movement of the boom through the boom operating unit;

an arm operating unit configured to control an arm, an arm cylinder and an extension of the arm cylinder to move the arm;

an arm lever configured to generate a second signal for controlling a movement of the arm through the arm operating unit;

an input device configured to output a third signal for initiating a boom float mode including: an arm-in mode in which the movement of the boom in ascending and descending directions is released while the arm moves inward, and an arm-out mode in which the movement of the boom in the ascending direction is released and in the descending direction is not allowed while the arm moves outward; and a control unit configured to output a flow path connection signal to at least one of the boom head return solenoid and the boom rod return solenoid to control the boom cylinder, and change the boom float mode from the arm-in mode to the arm-out mode or from the arm-out mode to the arm-in mode in accordance with a change of a manipulation direction of the arm lever in the boom float mode.

2. The construction equipment of claim 1, wherein when the boom float mode corresponds to the arm-in mode, the control unit outputs the flow path connection signal to the boom head return solenoid and the boom rod return solenoid to connect head and rod flow paths of the boom cylinder with a hydraulic tank.

3. The construction equipment of claim 2, wherein when a ground reaction force by a bucket in the arm-in mode is not generated, the boom descends through a contraction of the boom cylinder.

4. The construction equipment of claim 3, wherein when the ground reaction force by the bucket in the arm-in mode is generated, the boom is regulated so that the bucket moves along a corresponding ground.

5. The construction equipment of claim 1, wherein when the boom float mode corresponds to the arm-out mode, the control unit outputs the flow path connection signal to the boom rod return solenoid to connect a rod flow path of the boom cylinder with a hydraulic tank.

6. The construction equipment of claim 5, wherein the boom maintains a corresponding position or ascends when a ground reaction force by bucket is generated in the arm-out mode.

7. The construction equipment of claim 1, wherein the boom float mode further includes a boom down mode and when the boom float mode corresponds to the boom down mode, the control unit generates the flow path connection signal to the boom head return solenoid to connect a head flow path of the boom cylinder with a hydraulic tank.

* * * * *